US007357265B2

(12) United States Patent
Zoller

(10) Patent No.: US 7,357,265 B2
(45) Date of Patent: Apr. 15, 2008

(54) CONTAINER MADE OF A TRANSPARENT MATERIAL HAVING AN INSERT IN A SIDE WALL

(75) Inventor: Wolfgang P. Zoller, Paris (FR)

(73) Assignee: Wolf Concept S.A.R.L., Paris (FR)

( * ) Notice: Subject to any disclaimer, the term of this patent is extended or adjusted under 35 U.S.C. 154(b) by 322 days.

(21) Appl. No.: 10/737,152

(22) Filed: Dec. 15, 2003

(65) Prior Publication Data

US 2004/0140286 A1 Jul. 22, 2004

(30) Foreign Application Priority Data

Dec. 19, 2002 (FR) ..... 02 16196

(51) Int. Cl.
*B65D 1/04* (2006.01)

(52) U.S. Cl. ..... 215/6; 215/10; 215/386; 206/457; 220/23.2; 40/406; 40/410

(58) Field of Classification Search ..... 215/6, 215/10, 383, 385, 386, 379; 206/457, 514, 206/499; 220/23.2, 23.83, 23.86; 40/406, 40/410; 446/267
See application file for complete search history.

(56) References Cited

U.S. PATENT DOCUMENTS

D30,124 S * 1/1899 Olsen ..... D5/18
1,744,328 A * 1/1930 Morley ..... 215/383
2,018,878 A * 10/1935 Stein ..... 215/383
2,357,477 A * 9/1944 Killman ..... 374/150
2,505,037 A * 4/1950 Frumkin ..... 374/150
2,591,375 A * 4/1952 Radford ..... 62/130
3,295,672 A * 1/1967 Lemelson ..... 206/232
3,485,355 A * 12/1969 Stewart ..... 206/509
3,590,989 A * 7/1971 Wittwer ..... 206/568
3,807,713 A 4/1974 Cornett, III et al.
4,022,060 A * 5/1977 Rebhan ..... 374/150
4,507,099 A 3/1985 Kinberg (Continued)

FOREIGN PATENT DOCUMENTS

DE 19609972 6/1997

(Continued)

OTHER PUBLICATIONS

English language abstract of German Patent Publication No. DE 19609972, published Jun. 12, 1997, esp@cenet database.

*Primary Examiner*—Sue A. Weaver
(74) *Attorney, Agent, or Firm*—Cooper & Dunham LLP

(57) ABSTRACT

The invention discloses a container made of a transparent material. The container is of the type comprising, in one wall, a reserve into which is fixed a hollow sealed insert (4) containing a fluid in which particles can move. The container is characterized in that the insert (4) comprises a body (13) in the form of a dish intended to hold said fluid and a blanking plate (15) provided on the front face of the body (13), which extends beyond this face, forming an annular region (16) around the body (13), in that the reserve has a complementary shape to the insert (4), and in that the rear face (17) of this annular region (16) constitutes the region via which the insert (4) is fixed by bonding into the reserve. The invention can be used in bottles that have an insert.

18 Claims, 4 Drawing Sheets

U.S. PATENT DOCUMENTS

| | | | | | |
|---|---|---|---|---|---|
| 4,878,588 | A | * | 11/1989 | Ephraim | 215/11.2 |
| 5,029,700 | A | * | 7/1991 | Chen | 206/217 |
| 5,050,757 | A | | 9/1991 | Hidding et al. | |
| 5,156,283 | A | | 10/1992 | Sampson | |
| 5,201,431 | A | * | 4/1993 | Berger et al. | 215/386 |
| 5,269,717 | A | * | 12/1993 | Tardif | 446/71 |
| 5,351,851 | A | | 10/1994 | Powell | |
| 5,553,735 | A | * | 9/1996 | Kimura | 362/101 |
| D378,665 | S | | 4/1997 | Fenton et al. | |
| 5,772,065 | A | * | 6/1998 | Kalamaras | 220/612 |
| 5,901,715 | A | | 5/1999 | Cambon et al. | |
| 5,996,781 | A | * | 12/1999 | Glaser et al. | 206/217 |
| 6,062,380 | A | * | 5/2000 | Dorney | 206/217 |
| 6,066,021 | A | * | 5/2000 | Lee | 466/77 |
| 6,105,814 | A | * | 8/2000 | Chen | 220/625 |
| 6,138,870 | A | * | 10/2000 | Lin | 222/78 |
| 6,264,049 | B1 | * | 7/2001 | Shteynberg | 215/11.2 |
| 2004/0004829 | A1 | * | 1/2004 | Policappelli | 362/101 |

FOREIGN PATENT DOCUMENTS

| | | | | |
|---|---|---|---|---|
| EP | 0469220 | A1 | * | 2/1992 |
| EP | 0512180 | | | 11/1992 |
| FR | 500761 | | | 3/1920 |
| FR | 021802 | | | 6/2002 |
| WO | WO 0176953 | | | 10/2001 |

* cited by examiner

CONTAINER MADE OF A TRANSPARENT MATERIAL HAVING AN INSERT IN A SIDE WALL

FIELD OF THE INVENTION

The invention relates to a container made of a material which is transparent to light, and is intended to contain a product, particularly a transparent product such as a transparent liquid; the container having in at least one wall, a reserve or recess into which is fixed a hollow sealed insert which itself contains a fluid and in which particles, such as plastic beads, can move, possibly past a decoration.

BACKGROUND OF THE INVENTION

Containers of the type described above are known, but have as a major disadvantage that the fitting of the insert into the reserve or recess is detrimental to the aesthetic quality of the receptacle, something which is incompatible with containers particularly of luxury goods.

SUMMARY OF THE INVENTION

It is an object of the present invention to provide a container which alleviates the above described disadvantage of the prior art.

To achieve this objective, the container according to the invention is characterized in that: (1) the insert comprises a body in the form of a dish intended to hold the fluid and a blanking or sealing plate provided on the front face of the body extending beyond edge(s) of the front face, thereby forming an annular part surrounding the edge(s) of the body; (2) the reserve has a complementary shape to the insert; and (3) the rear face of the annular part constitutes the zone by which the insert is fixed by bonding into the reserve.

According to one embodiment of the invention, the reserve comprises, in its depth direction, a stepped profile comprising an annular part of shallow depth roughly equal to the thickness and shape of the annular part of the insert, and a deeper central part for accommodating the dish-shaped body.

According to another embodiment of the invention, the rear face of the annular part of the insert and/or the complementary face of the annular part of the reserve is opacified so as to prevent the adhesive from being visible.

According to another embodiment of the invention, the wall of the reserve is flat and the lateral faces of the annular part and of the central part are inclined with respect to the normal direction by a predetermined angle, the reserve widening toward the exterior face of the wall.

According to yet another embodiment of the invention, the reserve has a circular shape.

According to another embodiment of the invention, the annular part and the central part of the reserve, have a constant depth.

According to another embodiment of the invention, and especially when all or at least part of, the reserve and/or the insert are completely transparent, the inside end of the reserve and/or the end wall of the insert have/has a raised pattern which forms at least part of the aforesaid decoration.

The invention will be better understood and other objects, features, details and advantages thereof will become apparent in the explanatory description which follows with reference to the attached schematic drawings given solely by way of example illustrating one embodiment of the invention.

BRIEF DESCRIPTION OF THE DRAWINGS

FIG. 8 is a cutaway side view of the container and insert including the stud and hole according to one embodiment of this invention.

DETAILED DESCRIPTION OF THE INVENTION

Figure 1:
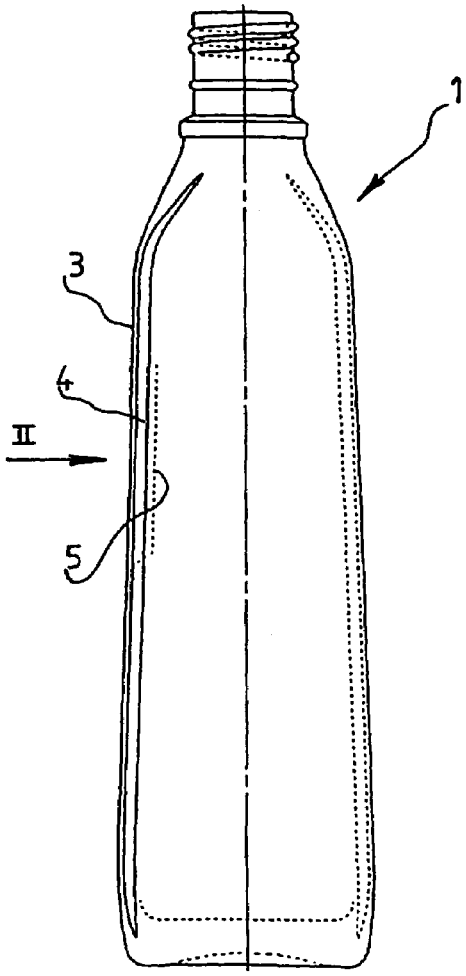
FIG. 1 is a side elevation of a container according to one embodiment of the invention.
Figure 2:
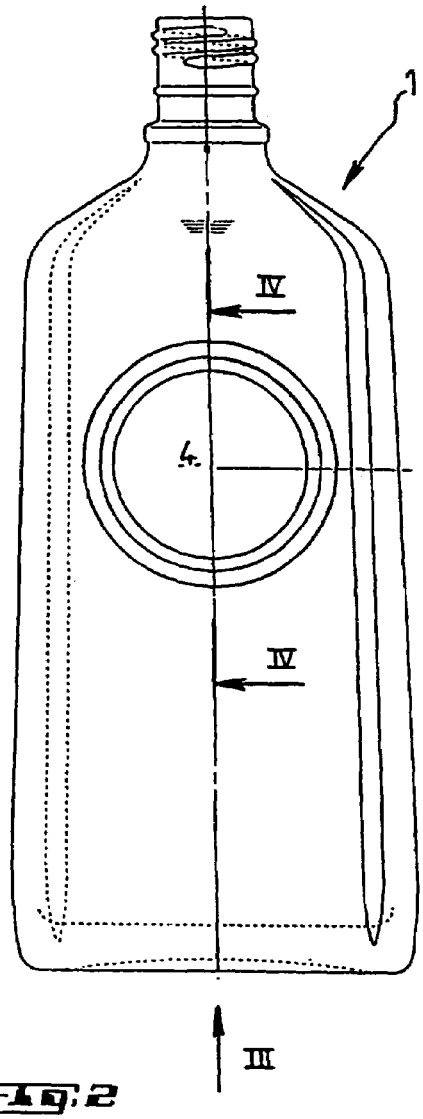
FIG. 2 is a front elevation of the container of FIG. 1 in the direction of arrow II in FIG. 1.
Figure 3:
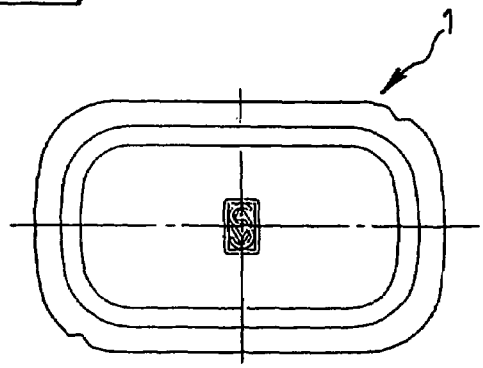
FIG. 3 is a bottom view from underneath the container of FIG. 1 in the direction of arrow III in FIG. 2.
Figure 4:
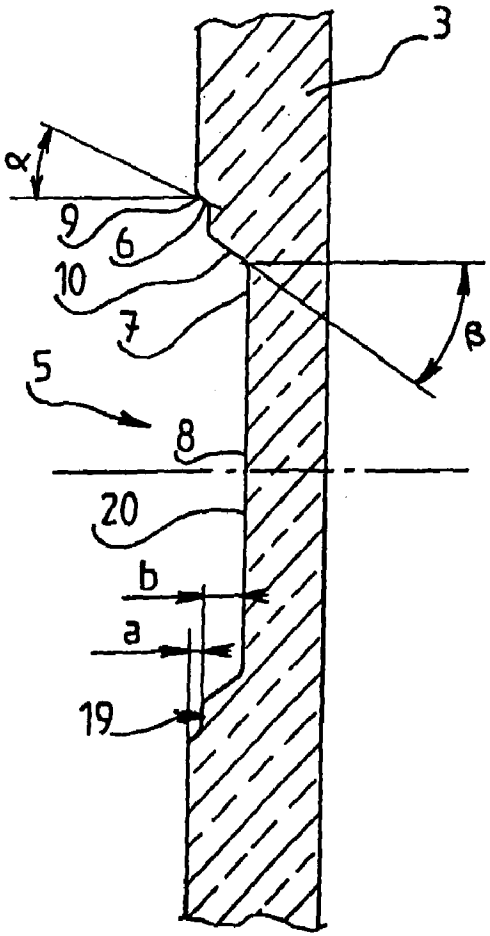
FIG. 4 is a cutaway side view of the container of FIG. 1 at a larger scale in the direction of arrows IV of FIG. 2.

The invention is described hereinafter in its application to a container 1 in the form of a bottle. As shown by FIGS. 1 to 3, this bottle has, in the view from above or from underneath, a roughly rectangular profile. The corners of the profile are rounded. This bottle comprises, in at least one of its long side walls, namely in wall 3, an insert 4 engaged in a reserve 5 formed as a circular recess made in this wall 3. This recess has, in the direction of its depth (into the wall), a stepped profile which is clearly visible in FIG. 4. The recess comprises an outer annular part 6 of a depth a and a central part 7 of a total depth b. The inside end 8 of the recess is flat and runs parallel to the exterior face of the wall 3 of the container 1. The lateral faces 9 of the annular part 6 of the recess and the lateral faces 10 of the central part 7 are inclined at predetermined angles $\alpha$ and $\beta$, respectively, relative to the direction which is perpendicular (normal) to the face of the wall 3, such that the two parts widen toward the exterior face of the wall 3.

Figure 5:
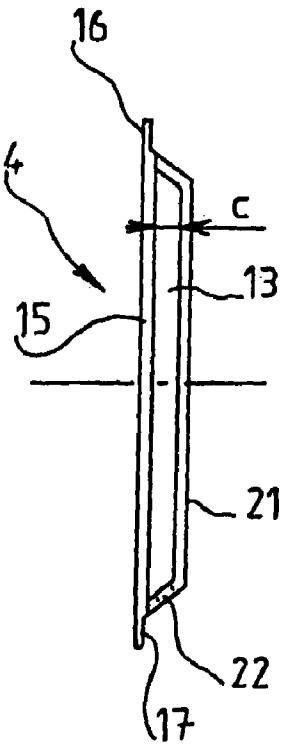
FIG. 5 is a side view in section of an insert according to one embodiment of the invention.
Figure 6:
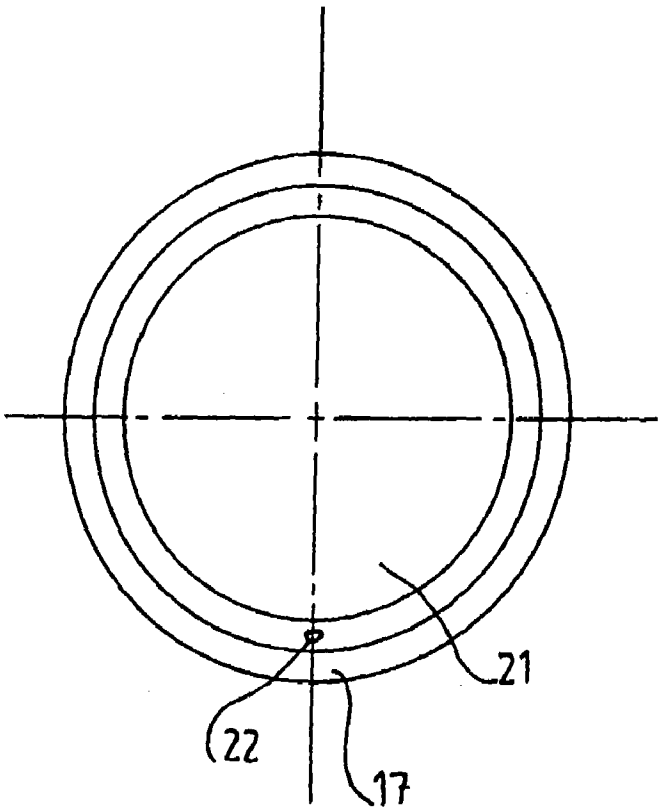
FIG. 6 is a front view of the insert of FIG. 5.

Referring to FIGS. 5 and 6 it may be seen that the insert 4 has a shape that complements that of the reserve 5 and is made in the form of a hollow body 13 in a material transparent to light, such as plastic, which is intended to contain a fluid, such as a liquid, and a transparent sealing or blanking plate 15 for closing off this hollow body.

The sealing plate 15 is fixed to the annular front rim of the dish-shaped body 13 and extends radially, beyond this rim forming an annular part 16 around the body.

The outside and inside diameters of the annular part 16 of the insert 4 are slightly smaller than the corresponding outside and inside diameters of the outer annular part 6 of the reserve 5 and the dimensions of the body 13 are slightly smaller than those of the central deeper part 7 of the reserve so that the insert can be fitted into the reserve with a relatively small predetermined tolerance, taking account of the aesthetic nature that the container 1 affords. The thickness of the annular part 16 of the insert 4 is slightly less than the depth of the annular part 6 of the reserve 5, advantageously, so that, when the insert is in place, the exterior face of the sealing plate 15 is flush with the exterior face of the wall 3 of the container 1. The exterior lateral faces of the annular part 16 and of the dish-shaped body 13 of the insert have angles of inclination corresponding to angles $\alpha$ and $\beta$ of the annular part 6 and the central part 7 of the reserve 5.

According to one embodiment of the invention, the insert 4 is fixed in the reserve 5 by bonding using an adhesive, preferably an invisible one, applied to at least one of the opposing faces of the annular part 16 of the insert 4 and of the annular part 6 of the reserve 5, that is, the rear face 17 allowing the annular part 16 of the insert 4 to be secured to the corresponding inside end face 19 of the annular part of the reserve 5.

In one embodiment of the invention, to prevent the adhesive-covered regions of the face 17 or the face 19, or both, from being visible through the container, at least one of these two faces can be opacified, for example given a grained appearance, or decorated accordingly.

Given that the insert 4 is fixed in the reserve 5 by bonding only at the annular faces 17 and 19, it is possible to provide on the inside end wall portion 20 of the reserve 5 and/or on the end wall 21 of the body of the insert 4, a raised pattern which can be colored if appropriate. This pattern can constitute or form part of a decoration, such as a relief, for use with animation means provided inside the insert 4, for example, in a fluid with which the insert is filled. These animation means could be elements in the form of beads able to move in the fluid according to the way in which the container is handled, for example, according to changes in position. This animation can be, for example, similar to the movement of simulated snow in a snow globe.

Given that the insert 4 is fixed into the reserve 5 on the outside of the region of animation visible through the walls of the container 1, the height c of the internal space of the insert can be varied in order to influence the movement of the animation elements.

It should also be noted that the inclined lateral faces of the body 13 and of the sealing plate 15 make it possible, when these elements are fabricated by molding, to be molded with easy mold release elements.

In one embodiment of the invention, a pluggable filling hole 22 is made in the lateral wall of the body 13 of the insert 4.

In another embodiment of the invention, the insert 4 can be formed with a stud 23 for positioning the insert in the reserve 5, which reserve is then provided with an appropriate hole 24 for accommodating the stud.

Similarly, the sealing plate 15 can be positioned on the body 13 of the insert 4 by means also involving one or more studs and an accommodating hole or holes.

While the insert and reserve used to illustrate the invention are described above as being circular, the invention can employ other shapes for the insert and the reserve, for example, rectangles, ovals, triangles, or complex shapes. Accordingly, the word 'annular' used throughout this specification means 'at least partially surrounding', in other words, 'adjacent and outside' and is not necessarily limited to completely surrounding or circular shapes.

Figure 7:
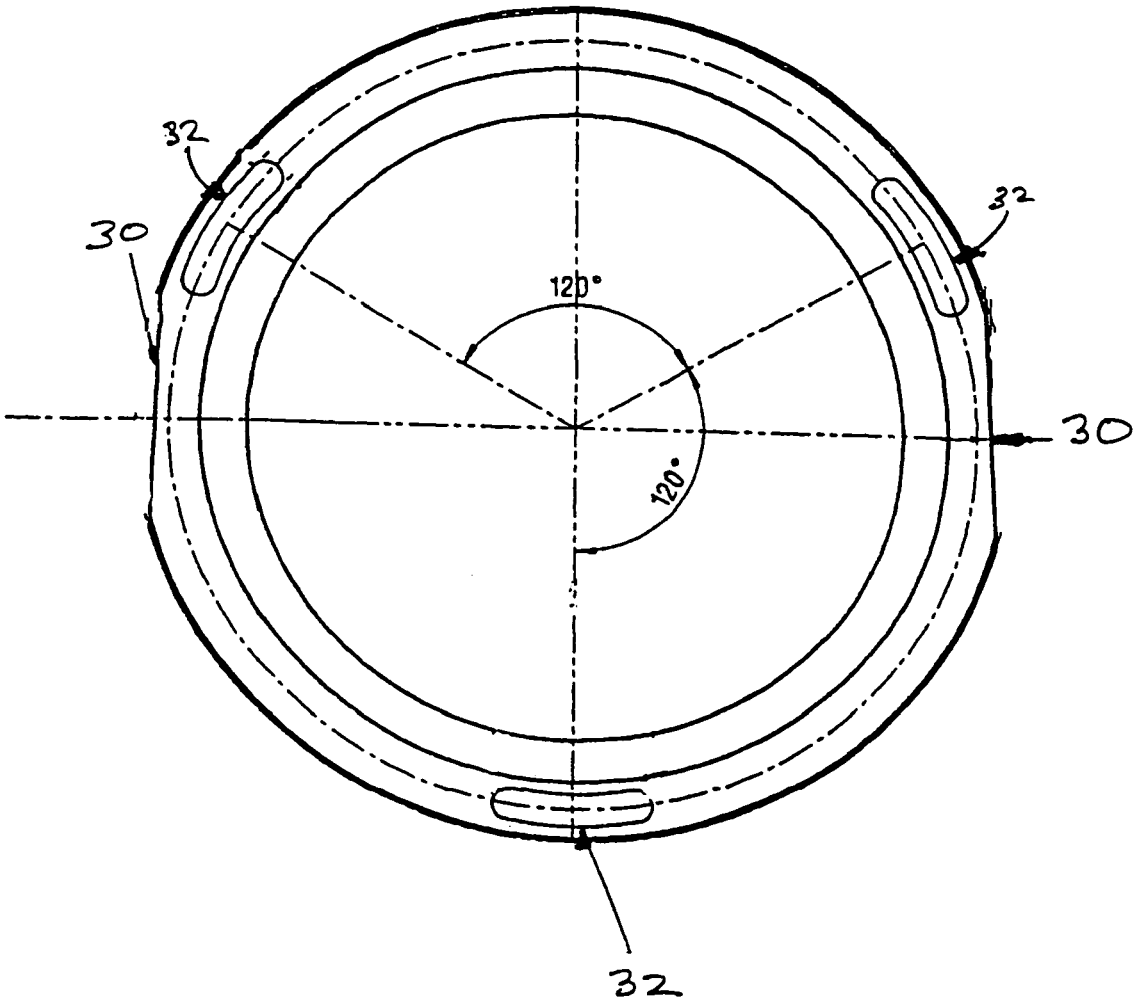
FIG. 7 is a front view of an insert according to one embodiment of the invention.
Figure 3:
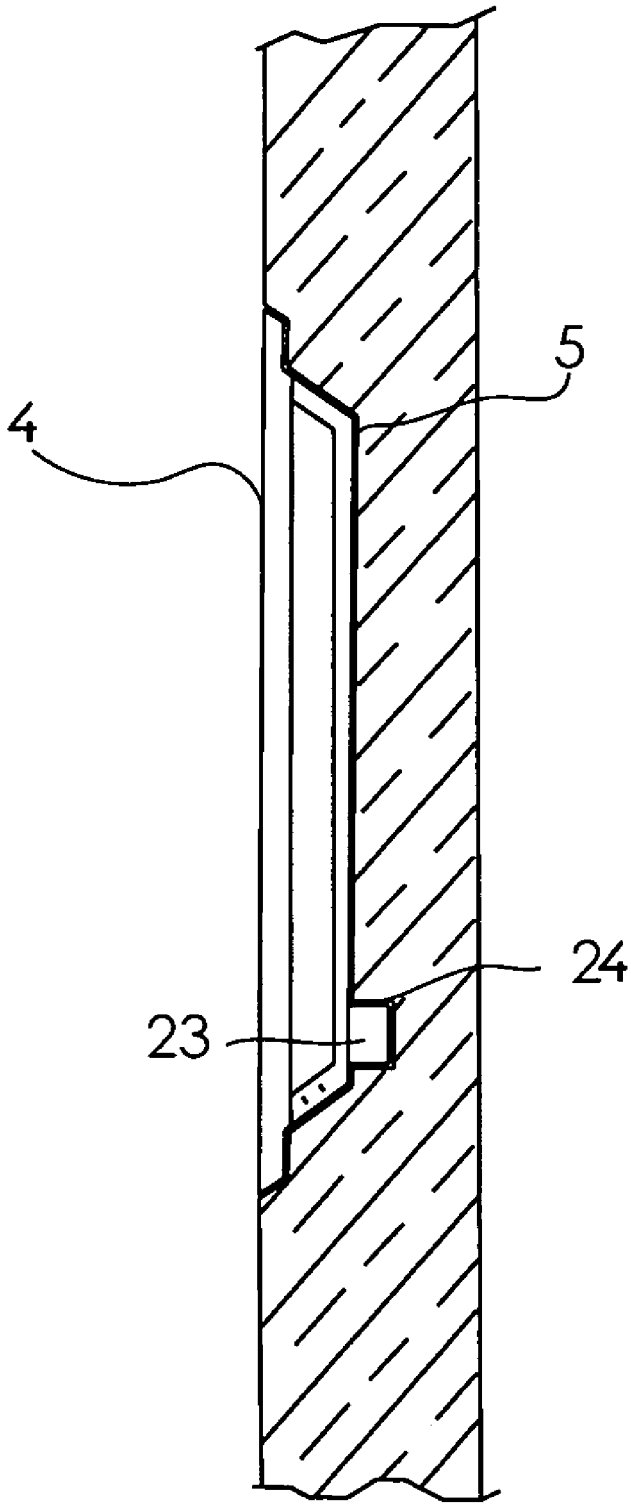

As shown in FIG. 7, in an embodiment in which the insert and the reserve are primarily circular, one or more positioning cuts 30 are made in the annular part 16 and corresponding positioning stops are made in the reserve 5. These cuts 30 act as a 'key' to properly position the insert 4 within the reserve 5 so that if the insert has a preferred orientation, for example, a decoration portraying a tree or village, the insert will only fit into the reserve in the preferred orientation. The cuts 30 can be made at approximately 90 degrees relative to the preferred top of the insert 4 and should not be parallel to each other and/or be the same size as each other to provide only one possible rotational position for the insert in the reserve 5.

Also, as shown in FIG. 7, one or more glue reservoirs 32 can be formed in the annular part 16 for holding the adhesive. In one embodiment, three such reservoirs 32 are positioned equidistantly about the annular part 16.

While the present invention has been described in terms of specific embodiments, this invention encompasses all variations and modification, including expedients by those skilled in the art, which come within the spirit of the specification and the scope of the appended claims.

What is claimed is:

1. A container having walls and intended to contain a product comprising:

a reserve in at least one of the walls into which is fixed a hollow sealed insert containing a fluid;

the insert having a body in the form of a dish to hold the fluid and a sealing plate which provides a seal for the front of the body, and extends beyond at least one edge of the body to form a part adjacent and outside the edge;

the reserve having a complementary shape to the insert such that the rear face of the part constitutes the bonding zone which fixes the insert in the reserve separate from the seal.

2. A container according to claim 1, further characterized in that the reserve comprises, in its depth direction, a stepped profile comprising a part of shallow depth roughly equal to the thickness of the part of the insert, and a deeper part for accommodating the body of the insert.

3. A container according to claim 2, further characterized in that the rear face of the part of the insert and/or a complementary face of the shallow part of the reserve is opacified or is provided with a decoration so as to prevent adhesive from being visible.

4. A container according to claim 1, further characterized in that the at least one of the walls is flat and lateral faces of the part of the reserve accommodating the body of the insert are inclined with respect to the normal direction to the wall by a predetermined angle, the reserve widening toward the exterior face of the wall.

5. A container according to claim 1, further characterized in that the reserve has a circular shape.

6. A container according to claim 1, further characterized in that the part of the insert and a part of the reserve accommodating the body of the insert have a constant depth.

7. A container according to claim 1, further characterized in that an inside end of the reserve and/or the end wall of the insert has a raised pattern which forms at least part of a decoration.

8. A container according to claim 1, further characterized in that the body of the insert comprises in a lateral wall, a pluggable filling hole.

9. A container according to claim 1, further comprising: means for orienting the insert in the reserve.

10. A container according to claim 9, wherein the means for orienting comprise at least one stud and at least one appropriate hole for accommodating the stud.

11. A container according to claim 9, wherein the means for orienting comprise at least one cut in the part of the insert and at least one corresponding stop in the reserve.

12. A container according to claim 1, further comprising: means for positioning the sealing plate on the body, the body and/or the sealing plate having a stud and a corresponding hole for accommodating the stud.

13. A container according to claim 1, further characterized in that the part on the insert completely surrounds the body.

14. A container according to claim 1, characterized in that at least part of the walls are made of a material which is transparent to light.

15. A container according to claim 1, characterized in that at least part of the insert is made of a material which is transparent to light.

16. A container according to claim 1, characterized in that at least part of the walls are made of a material which is partly covered by decoration.

17. A container according to claim 1, characterized in that at least part of the insert is made of a material which is partly covered by decoration.

18. A container according to claim 1, characterized in that the product is at least partly transparent to light.

* * * * *